US010507515B2

(12) United States Patent
Carr et al.

(10) Patent No.: US 10,507,515 B2
(45) Date of Patent: Dec. 17, 2019

(54) CERAMIC CORE FOR COMPONENT CASTING

(71) Applicant: United Technologies Corporation, Hartford, CT (US)

(72) Inventors: Jesse M. Carr, Hartford, CT (US); Michael G. McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 770 days.

(21) Appl. No.: 14/960,833

(22) Filed: Dec. 7, 2015

(65) Prior Publication Data

US 2016/0167112 A1 Jun. 16, 2016

Related U.S. Application Data

(60) Provisional application No. 62/091,665, filed on Dec. 15, 2014.

(51) Int. Cl.

| | |
|---|---|
| ***B22C 1/00*** | (2006.01) |
| ***B22C 9/10*** | (2006.01) |
| ***B22D 15/00*** | (2006.01) |
| ***B22D 25/02*** | (2006.01) |
| ***B22D 29/00*** | (2006.01) |
| ***F01D 5/18*** | (2006.01) |
| ***F01D 9/04*** | (2006.01) |
| ***F01D 11/08*** | (2006.01) |
| ***F01D 25/12*** | (2006.01) |

(52) U.S. Cl.

CPC ..... *B22C 1/00* (2013.01); *B22C 9/106* (2013.01); *B22D 15/00* (2013.01); *B22D 25/02* (2013.01); *B22D 29/002* (2013.01); *F01D 5/18* (2013.01); *F01D 9/041* (2013.01); *F01D 11/08* (2013.01); *F01D 25/12* (2013.01); *F05D 2220/32* (2013.01); *F05D 2230/211* (2013.01); *F05D 2260/20* (2013.01)

(58) Field of Classification Search

CPC .. B22C 1/00; B22C 9/10; B22C 9/106; B22D 15/00; B22D 25/02; B22D 29/00; B22D 29/002

USPC ..... 164/132, 369

See application file for complete search history.

(56) References Cited

U.S. PATENT DOCUMENTS 529,165 A 11/1894 Frischen
5,273,104 A * 12/1993 Renaud et al. ..... B22C 1/00 164/132

(Continued)

FOREIGN PATENT DOCUMENTS

DE 10212377 A1 10/2002
EP 0539317 4/1993

(Continued)

OTHER PUBLICATIONS

Extended European Search Report for Application No. 15200251.5 dated Apr. 25, 2016.

*Primary Examiner* — Kevin P Kerns

(74) *Attorney, Agent, or Firm* — Carlson, Gaskey & Olds, P.C.

(57) ABSTRACT

A casting ceramic core includes a ceramic structure having at least one through hole and a plurality of features extending from a main ceramic body. The ceramic body defines a negative space for a casting and a plurality of aligned fibers extending a substantial length of at least one casting feature.

19 Claims, 3 Drawing Sheets

(56) References Cited

U.S. PATENT DOCUMENTS

| | | | | |
|---|---|---|---|---|
| 5,295,530 | A * | 3/1994 | O'Connor et al. | B22C 9/04 164/133 |
| 5,810,552 | A | 9/1998 | Frasier | |
| 5,924,483 | A | 7/1999 | Frasier | |
| 6,196,794 | B1 | 3/2001 | Matsumoto | |
| 6,244,327 | B1 | 6/2001 | Frasier | |
| 6,286,582 | B1 | 9/2001 | Chartier et al. | |
| 6,431,255 | B1 * | 8/2002 | Ghosh et al. | B22C 9/04 164/361 |
| 6,913,064 | B2 | 7/2005 | Beals et al. | |
| 8,096,343 | B2 | 1/2012 | Whitton | |
| 2005/0133188 | A1 * | 6/2005 | Fick et al. | B22D 19/14 164/98 |
| 2014/0110077 | A1 * | 4/2014 | White | B22D 41/00 164/47 |
| 2015/0367412 | A1 * | 12/2015 | Wagner et al. | B22C 9/106 164/132 |

FOREIGN PATENT DOCUMENTS

| | | |
|---|---|---|
| EP | 0899039 | 3/1999 |
| WO | 2014197233 | 12/2014 |

* cited by examiner

CERAMIC CORE FOR COMPONENT CASTING

CROSS-REFERENCE TO RELATED APPLICATION

This Application claims priority to U.S. Provisional Application No. 62/091,665 filed Dec. 15, 2014.

TECHNICAL FIELD

The present disclosure relates generally to castings, and specifically to ceramic cores for casting of components such as turbine airfoils.

BACKGROUND

Gas turbine engines, as well as other turbine based assemblies, utilize a compressor section that compresses a fluid, a combustor that mixes the fluid with a fuel and ignites the mixture, and a turbine section across which the resultant combustion gasses are expanded. The expansion of the combustion gasses drives rotors within the turbine section to rotate. The turbine rotors are mechanically connected to a shaft, and rotation of the turbine rotors drives rotation of the shaft. The shaft is, in turn, connected to rotors within the compressor section and drives rotation of the rotors in the compressor.

In a typical turbine based assembly, each of the rotors includes a radially inward rotor disk with multiple rotor blades protruding radially outward from the rotor disk. Due to the extreme temperatures encountered by the rotor blades, the rotor blades are actively cooled by passing a cooling fluid through internal passages within the rotor blade.

Rotor blades including such cooling passages are frequently created using an investment casting process, where a rotor blade is cast around a destructible core. Once the cast has cooled, the destructible core is destroyed and removed from within the rotor blade, leaving one or more internal cavities that form the cooling passages.

SUMMARY OF THE INVENTION

In one exemplary embodiment, a casting ceramic core includes a ceramic structure having at least one through hole and a plurality of features extending from a main ceramic body. The ceramic body defines a negative space for a casting and a plurality of aligned fibers extending a substantial length of at least one casting feature.

In another exemplary embodiment of the above-described casting ceramic core, the at least one through hole is defined by one or more thin ceramic walls.

In another exemplary embodiment of any of the above-described casting ceramic cores, the aligned fibers and the ceramic core are chemically destructible via at least one shared chemical.

In another exemplary embodiment of any of the above-described casting ceramic cores, the aligned fibers are chemically destructible via a first chemical.

In another exemplary embodiment of any of the above-described casting ceramic cores, the ceramic body is chemically destructible by a second chemical.

In another exemplary embodiment of any of the above-described casting ceramic cores, the first chemical and the second chemical are distinct chemicals.

In another exemplary embodiment of any of the above-described casting ceramic cores, the plurality of aligned fibers are impregnated in the ceramic body.

In another exemplary embodiment of any of the above-described casting ceramic cores, the plurality of aligned fibers includes a first set of fibers aligned in a first direction, and a second set of fibers aligned in a second direction.

In another exemplary embodiment of any of the above-described casting ceramic cores, the first set of fibers and the second set of fibers are interwoven.

In another exemplary embodiment of any of the above-described casting ceramic cores, a weave angle of the first set of fibers and the second set of fibers is between 0 and 90 degrees.

In another exemplary embodiment of any of the above-described casting ceramic cores, each of the plurality of aligned fibers is included in a fiber bundle.

In another exemplary embodiment of any of the above-described casting ceramic cores, the ceramic body includes a plurality of through holes, each of the plurality of through holes being defined by at least one thin ceramic wall.

In another exemplary embodiment of any of the above-described casting ceramic cores, a plurality of fibers in the at least one thin ceramic wall are aligned with a structural weakness of the thin ceramic wall, such that the structural weakness is reinforced.

In another exemplary embodiment of any of the above-described casting ceramic cores, the ceramic body further includes a plurality of ceramic body features extending from a main ceramic core body, each of the ceramic body features being defined by two or more edges, and each joint between the two or more edges being a rounded joint.

In another exemplary embodiment of any of the above-described casting ceramic cores, the negative space defines one or more internal cooling passages of a gas turbine engine component.

In another exemplary embodiment of any of the above-described casting ceramic cores, the plurality of aligned fibers extend approximately a full length of the at least one investment casting feature.

An exemplary method for casting a component includes, casting a first material around a casting ceramic core. The casting ceramic core is a fiber reinforced ceramic core including at least one thin wall, and destroying the casting ceramic core, thereby leaving a void defined within the cast material.

A further example of the above exemplary method includes destroying the casting ceramic core comprising washing the casting with a first chemical, thereby destroying at least one of a ceramic material and a fiber reinforcing material of the casting core.

In a further example of any of the above exemplary methods includes washing the casting with a first chemical destroys both of the ceramic material and a fiber reinforcing material of the casting core.

A cast component for a gas turbine engine includes a structure including an internal cooling void. The internal cooling void is defined during a casting process by a fiber reinforced casting ceramic core.

These and other features of the present invention can be best understood from the following specification and drawings, the following of which is a brief description.

DETAILED DESCRIPTION OF AN EMBODIMENT

Figure 1:
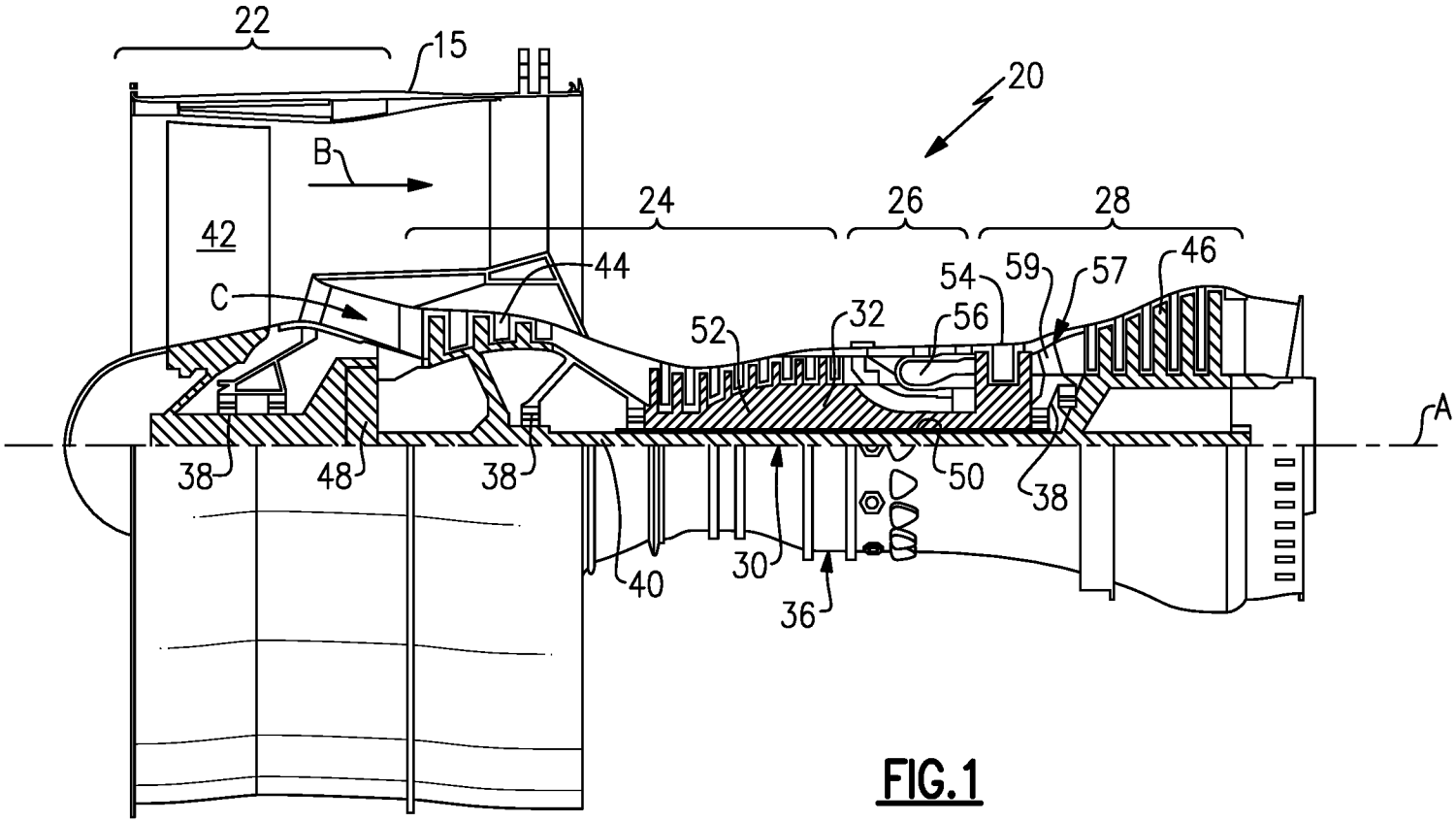
FIG. 1 schematically illustrates an exemplary gas turbine engine.

FIG. 1 schematically illustrates an exemplary gas turbine engine 20. The exemplary gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting example, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed example, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one example of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting example is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting example is less than about 1150 ft/second.

Contained within the compressor section 24 and the turbine section 28 are multiple stages, with each stage including a set of rotors and a corresponding set of stators. The rotors and stators extend across the core flow path C, with the stators remaining stationary relative to an engine static structure. The rotors rotate about the axis A defined by the exemplary gas turbine engine 20. Due to their presence in the core flow path C, the stators and rotors in the compressor section 24 and the turbine section 28 are exposed to high temperatures and are frequently cooled using internal cavities.

In some examples, the rotors and stators are cast as a single piece. In such examples, the internal cavities and passages are formed using a process referred to as investment casting. Investment casting utilizes a destructible core and casts a material, such as metal, around the destructible core. The destructible core is alternatively referred to as an investment casting core. Once the metal component has cooled, the destructible core is removed from the cast component leaving a void within the cast component, with the void being an inverse of the shape of the destructible core. The shape of the destructible or removable core is commonly referred to as a negative of the shape of the void.

One material used to construct destructible cores for investment casting is a ceramic material. Ceramic materials are brittle, and internal walls below a minimum thickness are susceptible to breakage during handling and processing steps involved in the casting process. Alternate methods of creating a less brittle destructible core using refractory sheet metal, or a combination of refractory sheet metal and ceramics have been attempted in the past. However, thermal expansion mismatches between the refractory metal and the ceramic in the destructible cores renders it difficult to create a suitable investment casting core using these materials.

Figure 2:
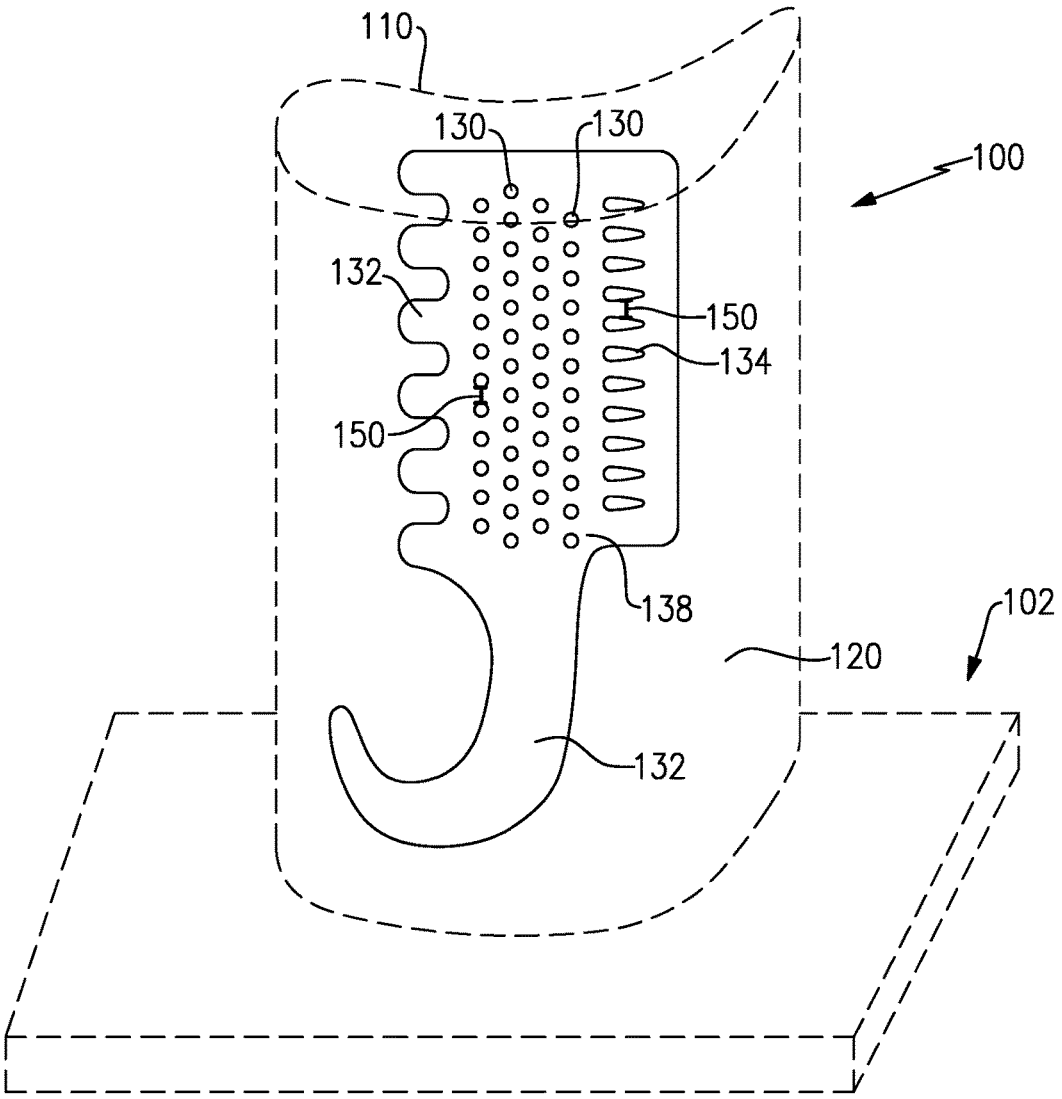
FIG. 2 schematically illustrates a cast rotor blade for use in a turbo machine.

FIG. 2 schematically illustrates a rotor blade 100 connected to a platform 102 for use in a turbo machine, such as the exemplary gas turbine engine 20 of FIG. 1. The rotor blade 100 has a cast rotor body 110 having an airfoil shaped profile. Similarly, the platform 102 is a solid cast piece. The cast rotor body 110 is defined by a solid metal portion 120 and a void 130. The void 130 is created using an investment casting core that is removed from the rotor blade 100 after the casting has cooled. The void 130 is defined by a central void 138 and multiple void features 132 protruding away from the central void 138. Each of the void features 132 is the inverse of a corresponding feature of the investment casting core. Further included within the void 130 are multiple post features 134 that extend through the void 130. Each of the post features 134 is connected to at least one end of the rotor blade 100 and is formed in the same casting process, such that the post features 134 and the solid metal portion 120 are a unitary metal piece.

Each of the post features 134 is formed in a through hole of the investment casting core during the casting process. Further, each of void features 132 is defined by two or more edges, and the joints between each of the two or more edges are rounded. The rounded joints are the result of rounded edge joints on the investment casting core, and provide structural benefits to the investment casting core prior to casting.

In the illustrated example, there is a thin gap 150 between some of the post features 134 and adjacent post features 134, with the gap 150 being defined as the shortest distance between a post feature 134 and the adjacent post feature 134. Investment casting ceramic cores with a negative image of the post features 134 have a thin ceramic wall defining where the gap 150 is. Due to the brittle nature of investment casting ceramic cores, the thin walls are highly susceptible to breakage during processing and handling before casting. This susceptibility to breakage is particularly noticeable when the thin walls are below a certain thickness.

Figure 3:
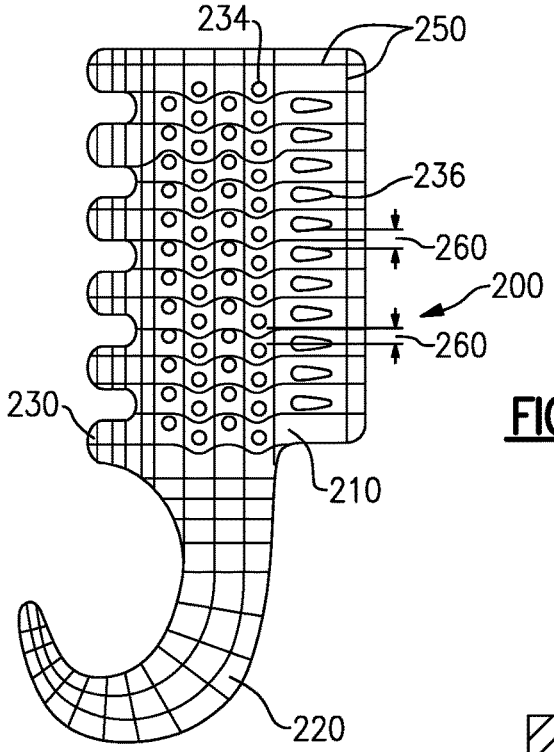
FIG. 3 schematically illustrates an example investment casting ceramic core for creating the internal cooling passages of the cast rotor blade of FIG. 2.

With continued reference to FIG. 2, FIG. 3 illustrates an example investment casting ceramic core 200 for casting the rotor blade 100 of FIG. 2. The investment casting ceramic core 200 is a ceramic structure having a main ceramic body 210, with multiple body features 220, 230 protruding outwardly from the main ceramic body 210. Multiple through holes 234, 236 pass through the ceramic body 200. Multiple thin walls 260 are defined between the through holes 234, 236 and adjacent through holes 234, 236.

As described above, the thin walls 260 are susceptible to breakage during handling of the investment casting ceramic core 200. In particular, each thin wall 260 is most susceptible to breakage due to shocks along a linear direction defining the length of the thin wall 260. In order to reduce the susceptibility to breakage, the investment casting ceramic core 200 is impregnated with multiple sets of fibers 250. In some examples, each set of fibers 250 is referred to as a fiber tow. Each set of fibers 250 includes individual fibers that extend a full length of the investment casting ceramic core 200. In alternate examples, the individual fibers 250 can extend a substantial length of the investment casting ceramic core 200, without extending the full length and achieve some of the described benefit. By way of example, a substantial length can be the full length of the main ceramic body 210.

The sets of fibers 250 passing through the thin walls 260 are aligned with the length of the thin walls 260, and provide reinforcement along the direction of the fiber 250, thereby reducing the susceptibility of the thin wall 260 to breakage during handling. In order to prevent thermal expansion mismatches between the fibers 250 and the ceramic, specific ceramic materials and the materials utilized to create the fibers 250 can be matched according to known ceramic matrix techniques. Further, by selecting mutually compatible fiber materials and ceramic materials, the investment casting cores do not require a coating during the investment casting process.

Another aspect of the investment casting ceramic core 200 that is susceptible to breakage during handling and processing are the corners formed at the joint between the multiple edges defining each of the body features 220, 230. The sharp edges create a more brittle weak spot where shocks incurred during handling are concentrated. In order to reduce the effect of these shocks, each the joints between the edges in the illustrated investment casting ceramic core 200 are rounded. The rounded joints further improve single crystal castings by reducing the incidence of grain defects relative to alternate production methods for casting thin walled passages.

Figure 4:
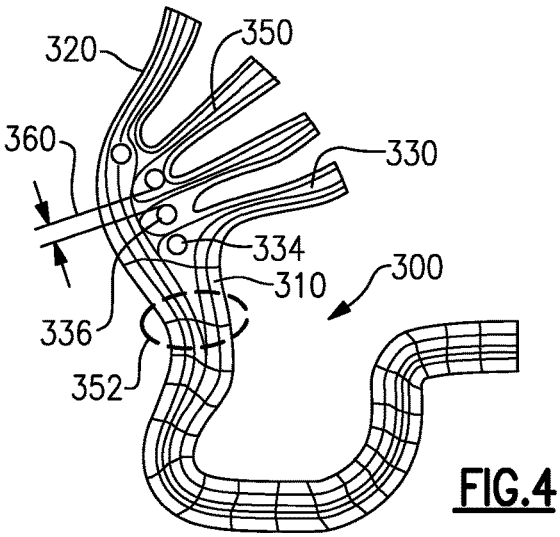
FIG. 4 schematically illustrates an alternate example investment casting ceramic core for creating an alternate internal cooling passage.

With continued reference to FIG. 2, FIG. 4 schematically illustrates an example investment casting ceramic core 300 for creating a cooling void within the platform 102. As with the example of FIG. 3, the investment casting ceramic core 300 is a ceramic structure having a main ceramic body 310, with multiple body features 320, 330 protruding outwardly from the main ceramic body 310. Multiple through holes 334, 336 pass through the ceramic body 300. Multiple thin walls 360 are defined between the through holes 334, 336 and adjacent through holes 334, 336.

Unlike the investment casting ceramic core 200 illustrated in FIG. 3, the investment casting ceramic core 300 illustrated in FIG. 4 utilizes unidirectional fibers 350 in some of the body features 320. The unidirectional fibers 350 are sets of fibers that extend at least the full length of the body feature 320, and are all aligned with the other unidirectional fibers 350 in the body features 320. When a set of unidirectional fibers 350 encounters another set of fibers 350 that are not aligned, such as at zones 352, the two sets of unidirectional fibers 350 are woven together to form a woven fiber set. The unidirectional fiber arrangement illustrated in FIG. 4 can be beneficially utilized in investment casting ceramic cores 300 where the main ceramic body 310 is not a standard geometric shape.

Figure 5:
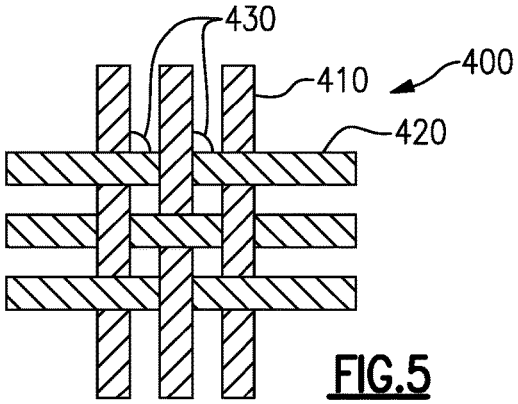
FIG. 5 schematically illustrates an exemplary ceramic core fiber weave.

As described above, with regards to FIGS. 3 and 4, the groupings of fibers 250, 350 within the investment casting ceramic core 200, 300 can be woven together in some or all portions of the investment casting ceramic core 200, 300. FIG. 5 illustrates one exemplary weave 400 suitable for weaving the fibers 350. The weave 400 is a two fiber weave. The two fiber weave utilizes fibers 410 in a uniform first direction and fibers 420 in a uniform second direction. Each fiber 410 in the first set of fibers 410 alternates passing over and passing under sequential fibers 420 oriented in the uniform second direction. This pattern is repeated as illustrated in the weave 400.

A weave angle of the weave 400 is defined as the angle 430 between fibers 410 in the first uniform direction and fibers 420 in the second uniform direction. In the illustrated example, the weave angle is 90 degrees. In alternative examples, the weave angle 430 can range from 0 degrees, in a unidirectional weave to the illustrated 90 degree angle 430.

Alternative weaves using a four fiber weave, an eight fiber weave, or any other known fiber weave can be utilized to similar effect, depending on the specific needs and designs of a given investment casting ceramic core.

With continued reference to FIGS. 2-4, during the investment casting process a component is cast around an investment casting core. Once the cast has been completed, the investment casting core is removed from the casting leaving a void, as described above. In order to remove the investment casting core, the investment casting core is typically destroyed either chemically or mechanically, and the destroyed investment casting core can be removed through significantly smaller openings than the investment casting core itself.

In a mechanical destruction, vibrations, impacts, or other mechanical stresses are used to destroy the investment casting core which is then manually removed. In the case of the fiber reinforced investment casting cores 200, 300 of FIGS. 3 and 4, the fibers and the ceramic material are removed through the same opening.

In a chemical destruction of the investment casting ceramic core 200, 300 of FIGS. 3 and 4, multiple processes can be used. In the first process, a single chemical capable of destroying both the fibers 250, 350 and the ceramic material is washed through the cast rotor blade. The destroyed investment casting ceramic core 200, 300, including both the fibers and the ceramic, is then washed out, leaving the void illustrated in FIG. 2. In the second process, two distinct chemicals are used to destroy the investment casting ceramic core 200, 300. The first chemical destroys the ceramic material leaving the fibers 250, 350 at least partially in place in the void. After the first chemical wash, a second chemical is used to destroy the remaining fibers and is washed from the void.

In a hybrid destruction process, the ceramic, and in some examples a portion of the fibers, can be destroyed using the above described chemical process, and the fibers can then be removed using a mechanical process.

While described above within the context of casting a rotor for a geared turbofan engine, one of skill in the art will understand that investment casting ceramic cores including the above described features can be utilized for casting rotor blades for use in any type of rotating machines including direct drive turbo machines, land based turbines, and marine based turbines. Further, a fiber reinforced investing casting core can be utilized in alternative castings beyond a rotor for a turbo machine and still fall within the auspices of the instant disclosure. By way of example, the casting core described above can be utilized to cast a rotor blade, a stator vane, a blade outer air seal, a platform for supporting a rotor component, a Tangential Onboard Injectors (TOBI), Radial Onboard Injectors (ROBI), Angled Onboard Injectors (AOBI), mid-turbine frames, turbine exhaust cases (TEC), bearing compartments, transition ducts, and anything including internal flow passages. In yet further alternatives, the casting core can be utilized to create a core including internal passages and voids for any type of cooling process and is not limited to air cooling.

Further, while the ceramic core described above is described with regards to investment castings, one of skill in the art, having the benefit of this disclosure, will understand that the ceramic casting core can be utilized in conjunction with other casting techniques such as die casting and is not limited to investment casting.

It is further understood that any of the above described concepts can be used alone or in combination with any or all of the other above described concepts. Although an example of this invention has been disclosed, a worker of ordinary skill in this art would recognize that certain modifications would come within the scope of this invention. For that reason, the following claims should be studied to determine the true scope and content of this invention.

The invention claimed is:

1. A casting ceramic core comprising:

a ceramic structure having a plurality of through holes and a plurality of features extending from a main ceramic body, wherein the ceramic body defines a negative space for a casting; and a plurality of aligned fibers extending a substantial length of at least one casting feature, and at least one through hole of the plurality of through holes displaces a longitudinal alignment of fibers in the plurality of aligned fibers.

2. The casting ceramic core of claim 1, wherein the aligned fibers and the ceramic core are chemically destructible via at least one shared chemical.

3. The casting ceramic core of claim 1, wherein the aligned fibers are chemically destructible via a first chemical.

4. The casting ceramic core of claim 3, wherein the ceramic body is chemically destructible by a second chemical.

5. The casting ceramic core of claim 4, wherein the first chemical and the second chemical are distinct chemicals.

6. The casting ceramic core of claim 1, wherein said plurality of aligned fibers are impregnated in said ceramic body.

7. The casting ceramic core of claim 1, wherein said plurality of aligned fibers includes a first set of fibers aligned in a first direction, and a second set of fibers aligned in a second direction.

8. The casting ceramic core of claim 7, wherein said first set of fibers and said second set of fibers are interwoven.

9. The casting ceramic core of claim 8, wherein a weave angle of said first set of fibers and said second set of fibers is between 0 and 90 degrees.

10. The casting ceramic core of claim 1, wherein each of said plurality of aligned fibers is included in a fiber bundle.

11. The casting ceramic core of claim 1, each through hole in said plurality of through holes is defined by at least one thin ceramic wall.

12. The casting ceramic core of claim 11, wherein a plurality of fibers in said at least one thin ceramic wall are aligned with a structural weakness of said thin ceramic wall, such that said structural weakness is reinforced.

13. The casting ceramic core of claim 1, wherein the negative space defines one or more internal cooling passages of a gas turbine engine component.

14. The casting ceramic core of claim 1, wherein the plurality of aligned fibers extend approximately a full length of the plurality of features extending from the main ceramic body.

15. The casting ceramic core of claim 1, wherein each of the through holes in the plurality of through holes displaces the longitudinal alignment of fibers in the plurality of fibers.

16. A casting ceramic core comprising:

a ceramic structure having at least one through hole and a plurality of features extending from a main ceramic body, wherein the ceramic body defines a negative space for a casting, each of said ceramic body features being defined by two or more edges, and each joint between said two or more edges being a rounded joint; and a plurality of aligned fibers extending a substantial length of at least one casting feature, wherein a longitudinal alignment of the plurality of fibers is displaced by the at least one through hole.

17. A method for casting a component comprising:

casting a first material around a casting ceramic core, wherein the casting ceramic core is a fiber reinforced ceramic core including a plurality of through holes and at least one thin wall defining a boundary between a first through hole in the plurality of through holes and a second through hole in the plurality of through holes, the casting ceramic core including also a plurality of aligned fibers extending a substantial length of at least one casting feature, and at least one through hole of the plurality of through holes displaces a longitudinal alignment of fibers in the plurality of aligned fibers; and destroying the casting ceramic core, thereby leaving a void defined within the cast material.

18. The method of claim 17, wherein destroying the casting ceramic core comprising washing the casting ceramic core with a first chemical, thereby destroying at least one of a ceramic material and a fiber reinforcing material of the casting core.

19. The method of claim 18, wherein washing the casting ceramic core with a first chemical destroys both of the ceramic material and a fiber reinforcing material of the casting core.

* * * * *